US010492582B2

(12) United States Patent
Miles

(10) Patent No.: US 10,492,582 B2
(45) Date of Patent: Dec. 3, 2019

(54) MULTIFUNCTION CONVERTIBLE SUITCASE SYSTEM

(71) Applicant: Stephen Miles, Falls Church, VA (US)

(72) Inventor: Stephen Miles, Falls Church, VA (US)

( * ) Notice: Subject to any disclaimer, the term of this patent is extended or adjusted under 35 U.S.C. 154(b) by 0 days.

(21) Appl. No.: 15/936,414

(22) Filed: Mar. 26, 2018

(65) Prior Publication Data

US 2018/0271240 A1 Sep. 27, 2018

Related U.S. Application Data

(60) Provisional application No. 62/476,798, filed on Mar. 26, 2017.

(51) Int. Cl.

| | |
|---|---|
| ***A45C 13/38*** | (2006.01) |
| ***A45C 7/00*** | (2006.01) |
| ***A45C 5/06*** | (2006.01) |
| ***A45C 5/14*** | (2006.01) |
| ***A45C 9/00*** | (2006.01) |
| ***A45C 13/04*** | (2006.01) |
| ***A45C 15/00*** | (2006.01) |
| *A45C 5/03* | (2006.01) |

(52) U.S. Cl.

CPC ..... *A45C 7/0022* (2013.01); *A45C 5/065* (2013.01); *A45C 5/141* (2013.01); *A45C 5/146* (2013.01); *A45C 7/0031* (2013.01); *A45C 7/0054* (2013.01); *A45C 9/00* (2013.01); *A45C 13/04* (2013.01); *A45C 13/385* (2013.01); *A45C 15/00* (2013.01); *A45C 2005/032* (2013.01); *A45C 2005/148* (2013.01)

(58) Field of Classification Search

CPC ..... A45C 5/146; A45C 7/0022; A45C 13/38; A45C 23/385; A45C 7/0086; A45C 2005/148; A45C 13/385

USPC ..... 190/8, 12 A, 15.1, 18 A, 108; 280/DIG. 3, 651

See application file for complete search history.

(56) References Cited

U.S. PATENT DOCUMENTS

| | | | | |
|---|---|---|---|---|
| 5,971,119 | A * | 10/1999 | Chi | A45C 7/0045 190/102 |
| 7,051,853 | B2 * | 5/2006 | Brown | A45C 5/14 190/1 |
| 7,584,830 | B2 * | 9/2009 | Smith | A45C 5/14 190/11 |
| 8,146,722 | B1 * | 4/2012 | Moreno | A45C 5/14 190/115 |
| 8,517,398 | B1 * | 8/2013 | Wilson | B62B 1/12 280/37 |
| 8,540,063 | B2 * | 9/2013 | LaTowsky | A45C 5/14 190/18 A |
| 8,662,267 | B1 * | 3/2014 | Hart | A45C 5/14 190/1 |
| 9,867,437 | B1 * | 1/2018 | Dohmann | A45C 7/0022 |

(Continued)

FOREIGN PATENT DOCUMENTS

| | | | | |
|---|---|---|---|---|
| FR | 2722667 | A3 * | 1/1996 | A45C 5/14 |

*Primary Examiner* — Sue A Weaver

(57) ABSTRACT

A multifunction suitcase system that provides greater convenience and ease of travel by providing a means for transporting and organizing additional items of luggage and personal belongings. The suitcase is able to be configured to provide the utility of a luggage cart, a shopping cart, a shopping basket, a stool, a table, and attachment points for LATCH system infant car seats.

4 Claims, 7 Drawing Sheets

(56) References Cited

U.S. PATENT DOCUMENTS

| | | | | |
|---|---|---|---|---|
| 2003/0034215 | A1* | 2/2003 | Lin | A45C 5/14<br>190/18 R |
| 2005/0145458 | A1* | 7/2005 | Cohen | A45C 5/065<br>190/18 A |
| 2005/0199459 | A1* | 9/2005 | Harvey | A45C 5/14<br>190/108 |
| 2010/0059970 | A1* | 3/2010 | Scott | A45C 9/00<br>280/658 |
| 2011/0247910 | A1* | 10/2011 | Darvish | A45C 5/146<br>190/18 A |
| 2013/0175129 | A1* | 7/2013 | Rankin | A45C 5/14<br>190/18 A |
| 2014/0190780 | A1* | 7/2014 | Blazure | A45C 5/146<br>190/1 |
| 2015/0075933 | A1* | 3/2015 | Clarke | A45C 9/00<br>190/8 |
| 2015/0208776 | A1* | 7/2015 | Bennett | A45C 9/00<br>190/15.1 |
| 2015/0313334 | A1* | 11/2015 | Gadzinski | A45C 5/146<br>190/11 |
| 2017/0354219 | A1* | 12/2017 | Kim | A45C 9/00 |

* cited by examiner

MULTIFUNCTION CONVERTIBLE SUITCASE SYSTEM

BACKGROUND OF THE INVENTION

The invention relates to suitcases and other forms of luggage. More specifically the invention comprises a suitcase that can deploy multiple useful structures to assist the traveling public in the transport and organization of their belongings. Furthermore, it is capable of converting to a seat or a table while still retaining the function and storage capacity of conventional suitcases.

Some form of luggage is used by virtually every traveler. In its many years in the marketplace one of the few significant innovations that has been almost universally adopted is the inclusion of wheels. Wheeled luggage clearly solves the problem of how a single individual can move one or two heavy suitcases over the expansive areas at airports and other transportation terminals.

However, many problems remain for the traveling public. There are frequently circumstances when a single individual may have to be responsible for moving more items of luggage and personal belonging than they can easily and safely manage. As more people travel, it has become harder to find seats or tables in terminals and waiting areas. It is now far more common to see people traveling with infant and child car seats. Furthermore, security has become more stringent requiring that certain items be unpacked or removed (e.g. jackets, shoes, and laptops).

What is lacking is a suitcase system that addresses, not one, but many if not all of the common challenges the traveling public faces in a manner that provides for ease of use and with minimal reduction in the storage capacity of the suitcase. The present invention seeks to do just that, by providing a suitcase that can be easily converted to provide the function of a luggage cart, a seat, a table, a car seat carrier, a shopping cart, and other useful configurations.

SUMMARY OF THE INVENTION

The object of the present invention is to offer the traveling public a multifunction suitcase that provides for improved convenience in the transport and organization of luggage and other personal belongings. More specifically, It is an object of the invention to provide a suitcase that offers the following features:

- A luggage cart
- A shopping cart
- A stool
- A table
- Attachment points compatible with the LATCH system used by many infant/child car seats, as well as other common connection clips such as carabiners.

DETAILED DESCRIPTION OF THE INVENTION

The following is a description of the preferred embodiment of the invention. The exact position, arrangement, and size (or scale) of the components of the invention may be easily altered by a person skilled in the art while still retaining the same function. It should be made clear that the features of the invention are intended to apply to suitcases across the full range of standard sizes, from the smallest carry on suitcase to the maximum size permitted for commercial air travel. The description and drawings of the invention are merely illustrative, to a person skilled in the art, of the utility and overall principles involved. As such the embodiments described herein should not be seen as limiting the invention to a particular style of luggage (e.g. hardside suitcase, softside suitcase, duffel bags, and other forms of luggage). Certain drawings may omit structural components that might hinder the view and understanding of the specific function being illustrated.

Figure 1:
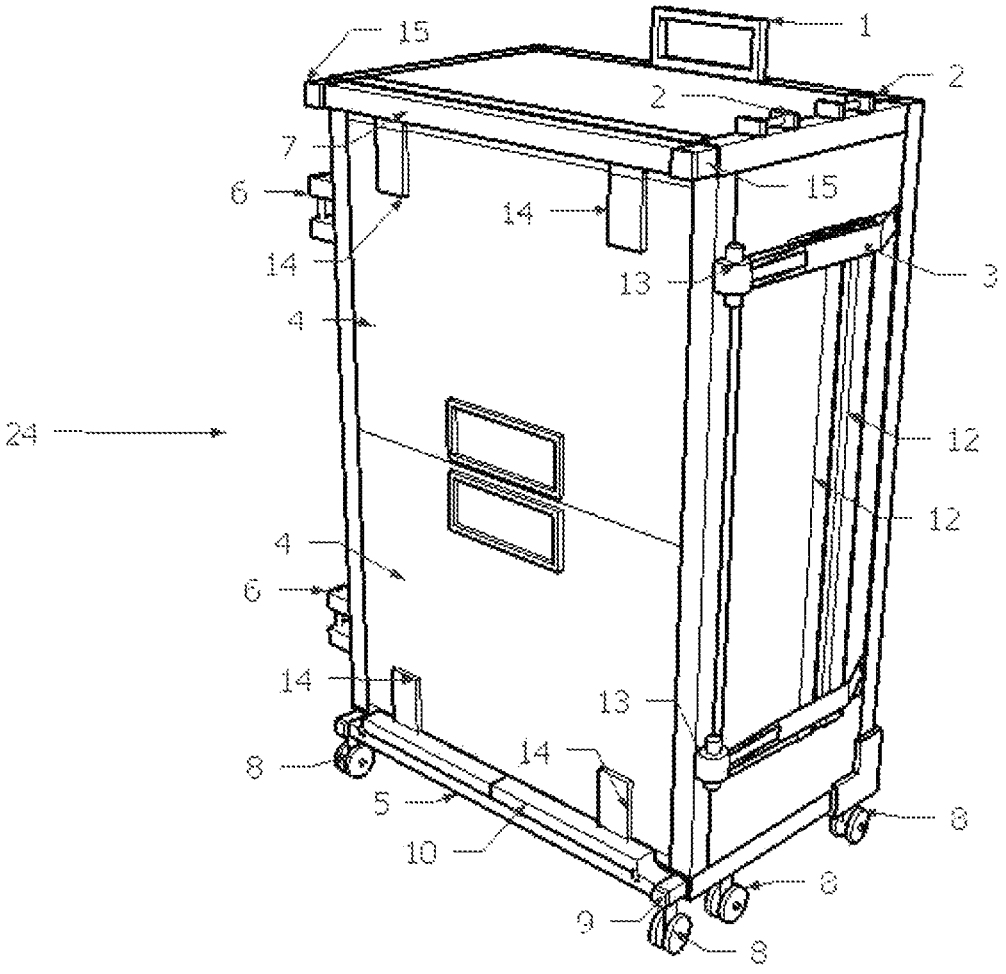
FIG. 1 Shows a front perspective view of the invention with the deployable and telescopic features stowed.

FIG. 1 show the invention 24 with its deployable and telescopic features stowed. It is shown to have double doors 4 that rotate open and closed via two pairs of hinges 14. Other methods of opening and closing, the suitcase would be equally acceptable. In this embodiment the shopping cart receptacle 3 is folded and secured (the securing mechanism may include, but is not limited to, velcro straps, or retention clips) along the side of the invention. This is merely one of numerous options for stowing the shopping cart receptacle 3 when not in use.

Figure 2:
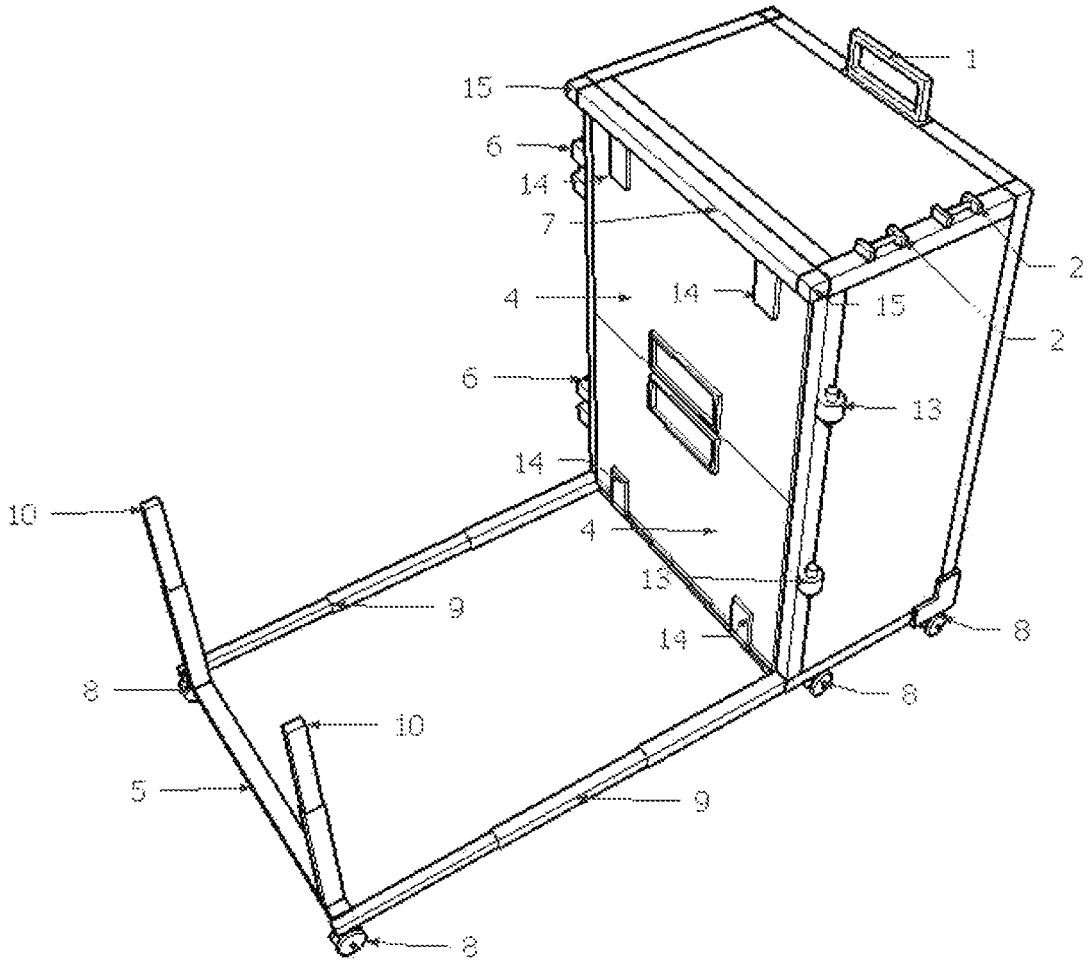
FIG. 2 Shows a front perspective view of the invention with the luggage cart feature extended, and the shopping cart receptacle stowed.

FIG. 2 shows the suitcase with the luggage cart feature extended into position. The luggage cart may be extended incrementally by adjusting the length of the telescopic base 9. Once the luggage cart feature has been extended to the desired position it may be locked or held in place by a friction lock, locking pin, or a number of other similar devices that would be known to a person skilled in the art. At the end of the telescopic base 9 is a support structure 5 that stabilizes the telescopic base components 9 and provides a means for their manual extension (i.e. a structure that the user can grip in order to push or pull the telescopic base 9 into position). The wheels 8 of the suitcase are illustrated as 3 pairs for a total of 6 wheels, as distinct from the single pair (2 wheels) or 2 pairs (4 wheels) found on the majority of suitcases. This provides support and stability when the luggage cart is maximally extended (i.e. a pair of wheels are attached to the telescopic structure that forms the luggage cart and move with said structure).

Figure 4:
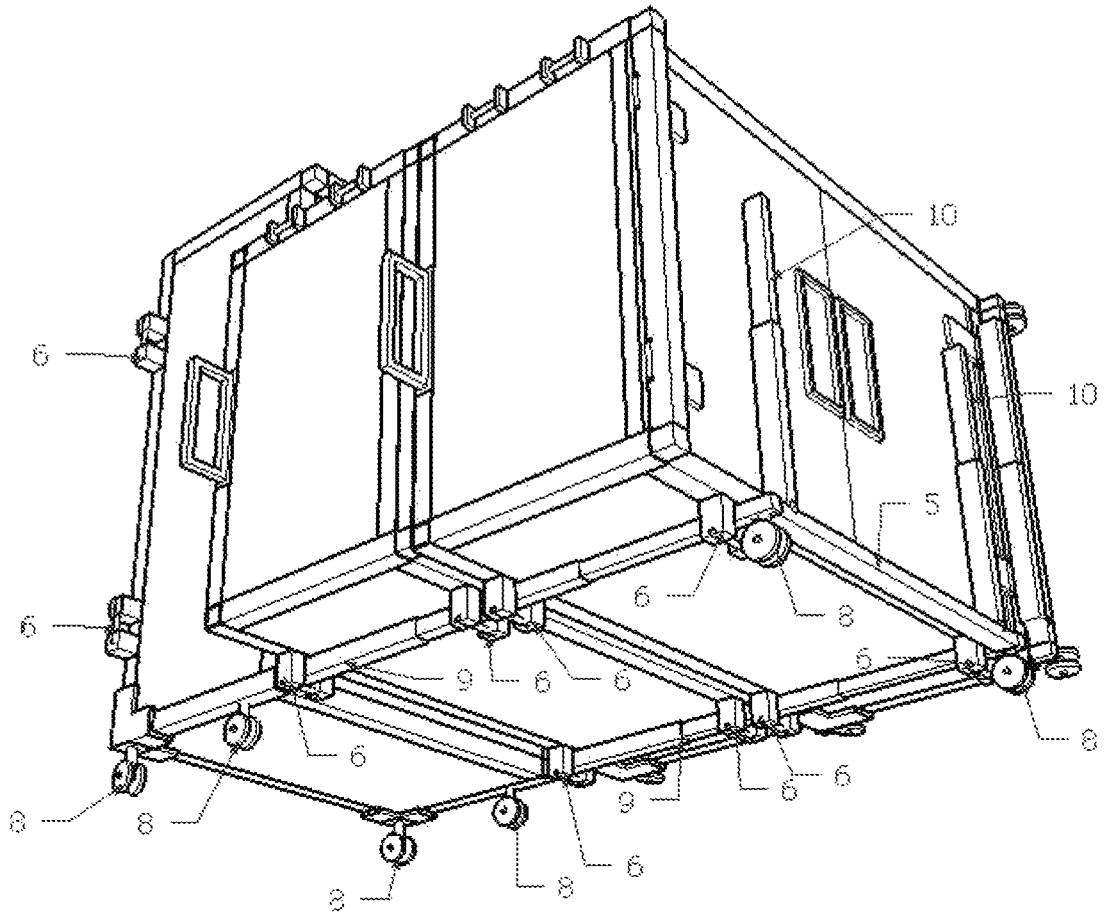
FIG. 4 Shows an underside perspective view of the invention with the luggage cart extended and luggage (identical suitcases to that of the invention) in place on said cart for the purpose of illustrating the utility of the attachment points in securing a suitcase in position on the telescopic base that forms the luggage cart.

FIG. 4 shows an underside perspective view of the invention configured as a luggage cart with identical suitcases to that of the invention resting on the cart with all of their deployable and telescopic features stowed. The purpose of this drawing is to show that, in its preferred form the invention may have luggage cart attachment points 6. The luggage cart attachment points 6 are shown as two pairs along the side of the suitcase resting on the telescopic base 9. The luggage cart attachment points 6 consist of a groove made specifically to allow it to be securely attached to the telescopic structures of the luggage cart feature of another suitcase identical to that of the invention. The connection between the luggage cart attachment point 6 and the telescopic base 9 is achieved by having the telescopic base 9 rest within the groove or slot of the luggage cart attachment point 6. This connection may be further strengthened and stabilized by user controlled adjustments to the dimensions of the luggage cart attachment points 6 alone or in combination with a locking or retention mechanism. The locking or retention mechanism would prevent the luggage cart attachment points 6 from becoming, separated from the telescopic base 9 that rests within its groove.

Figure 3:
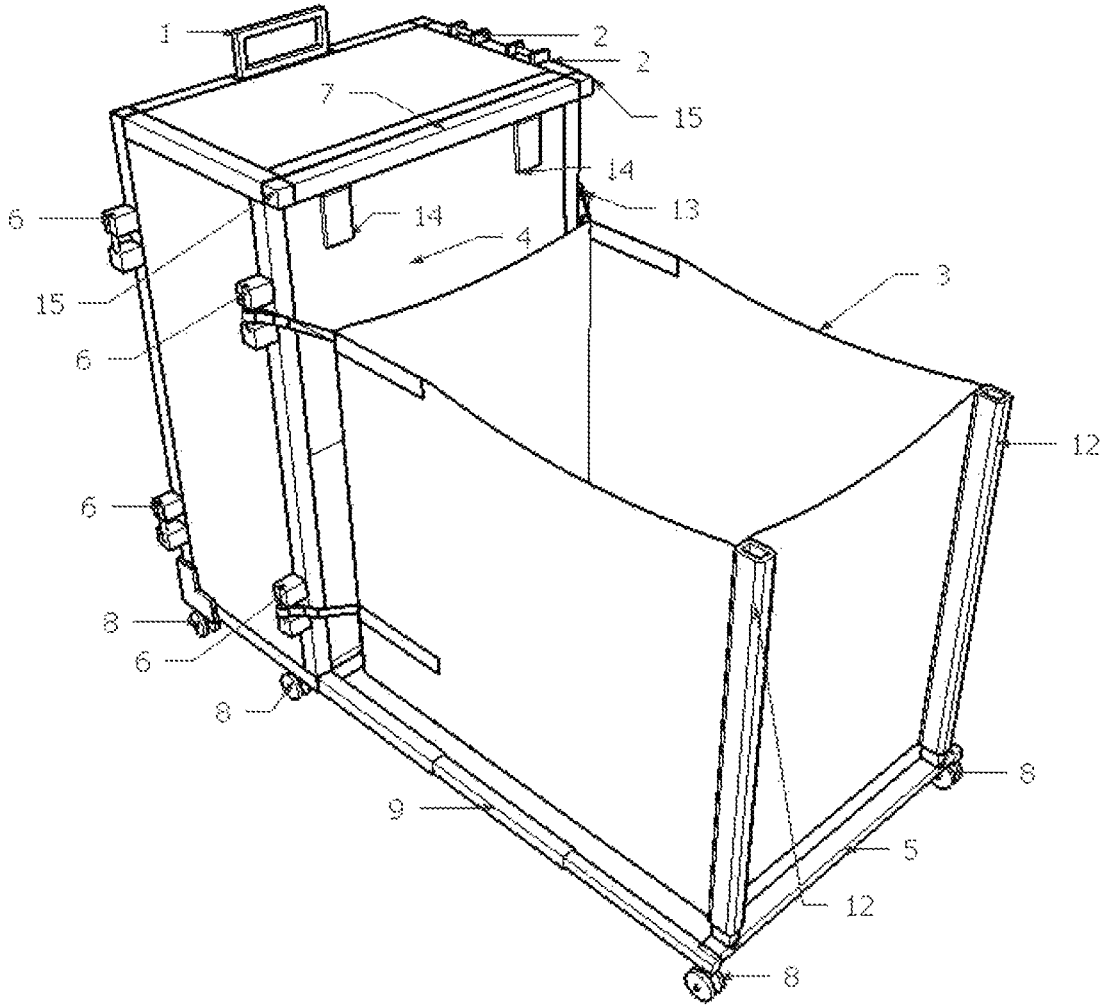
FIG. 3 Shows a front perspective view of the invention with the shopping cart receptacle in place.

The telescopic base 9 shown in FIG. 2 has vertical support structures 10 that can either be fixed in position or rotate into their vertical position and may themselves be telescopic to provide further vertical extension. FIG. 3 shows that these vertical structures 10 serve multiple purposes as in addition to stabilizing the items on the luggage cart they may also be used as attachment points for a deployable receptacle 3 made of light flexible material (though not limited to only such material) designed to turn the luggage cart into a shopping cart. This would be particularly useful for small items, that might fall through the typical luggage cart, or large, irregular, or non-rigid items that might also not be stable on a luggage cart. The mechanism for attaching the receptacle 3 to the vertical support structures 10 and other structural components may vary, but in its preferred form includes a sleeve like structure 12 incorporated into the receptacle 3 that may slide over vertical support structure 10. The portion of the shopping cart receptacle 3 that is closer to the front face of the suitcase may be secured via clips or other common retention mechanism to the luggage cart attachment points 6 or to a dedicated attachment points 13 along the side of the suitcase. The receptacle 3 used to form the shopping cart may be designed to have handle structures that allow it to not only be deployed and stowed as necessary, but also to be removed from all attachment points and to be used as a handheld receptacle separate from the suitcase.

Figure 5:
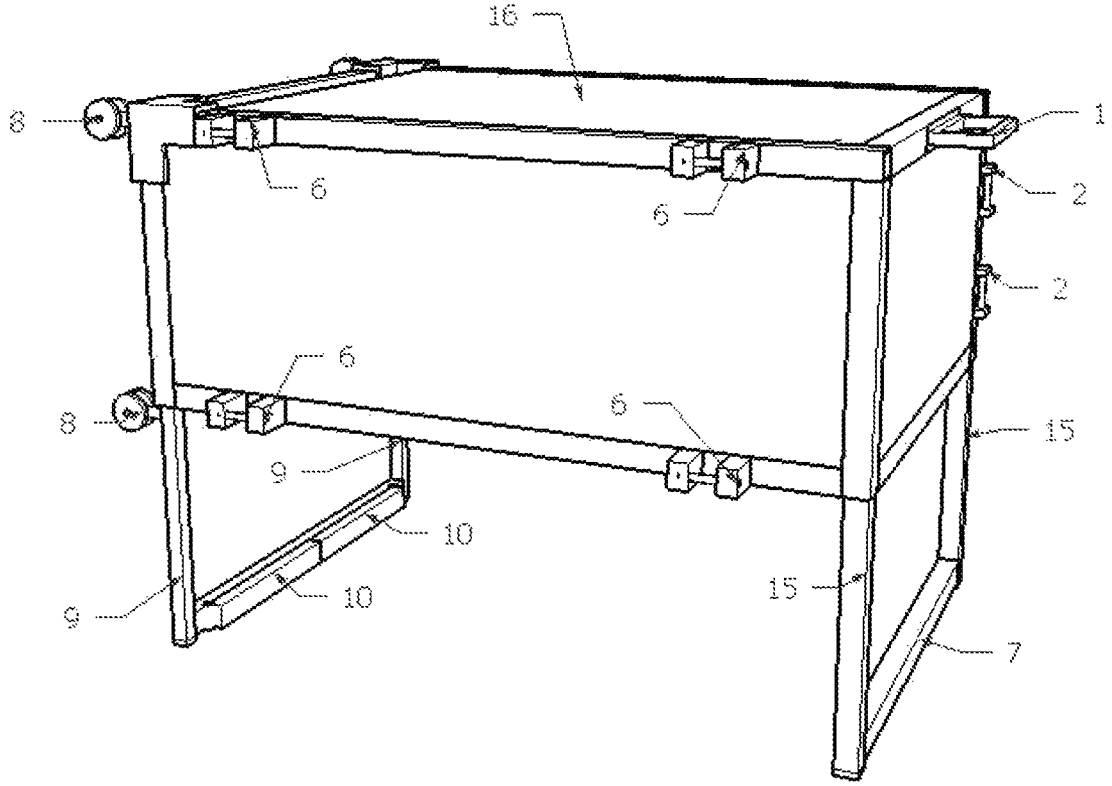
FIG. 5 Shows a perspective view of the invention when configured as a stool or table.

The telescopic base of the suitcase when deployed can also be used, in combination with telescopic leg structures 15 that deploy from the top of the suitcase and parallel to those of the base, to form a stool or table 16, as seen in FIG. 5. Attached to the telescopic legs 15 is a support structure 7 for said telescopic legs, which among other functions serves to provide greater strength and stability to the telescopic legs 15. All telescopic components of the invention including but not limited to, the base 9, and telescopic legs 15, may be extended incrementally. This allows the user to adjust the dimensions of the telescopic features of the invention to best meet their needs in any given configuration.

Figure 7:
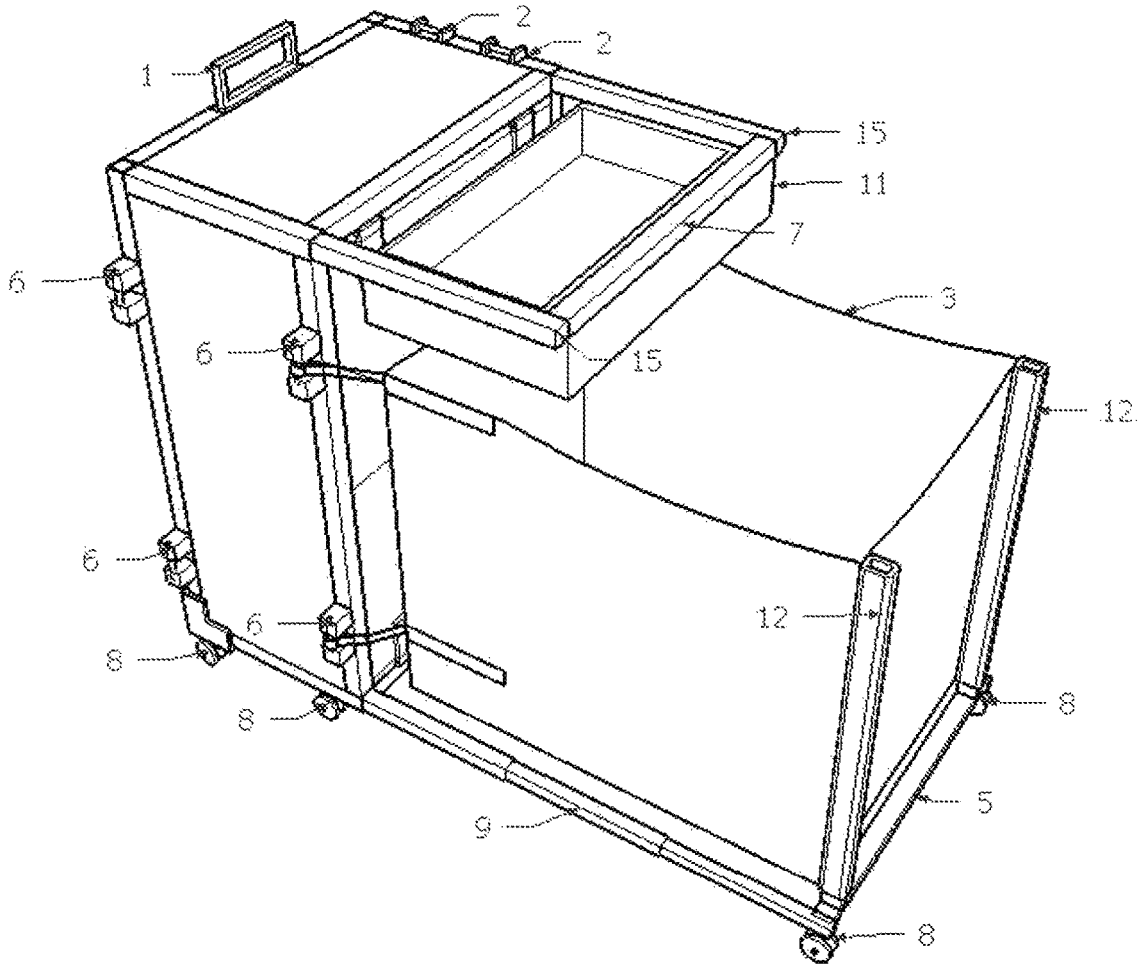
FIG. 7 Shows a front perspective view of the upper telescopic legs extended with removable shopping basket receptacle in place with simultaneous use of the larger shopping cart receptacle.

The telescopic leg structures 15, and support structure 7 may be used to attach a basket or receptacle 11 which may be composed of lightweight flexible material (though not limited to such material). This receptacle may be used concurrently or independently from the luggage cart and shopping cart features shown in FIGS. 2 and 3 respectively. FIG. 7 is a front overhead perspective view which shows the shopping basket receptacle 11 suspended from the telescopic leg structures 15, and support structure 7, while the lower luggage cart is also deployed with the shopping cart receptacle 3 in place. The telescopic leg support structure 7 may also be used as a hand grip to assist in the telescopic extension of telescopic leg structures 15. The mechanism by which the shopping basket receptacle is attached to structures 7 and 15 may include (but is not limited to) retention clips and velcro straps.

Figure 6:
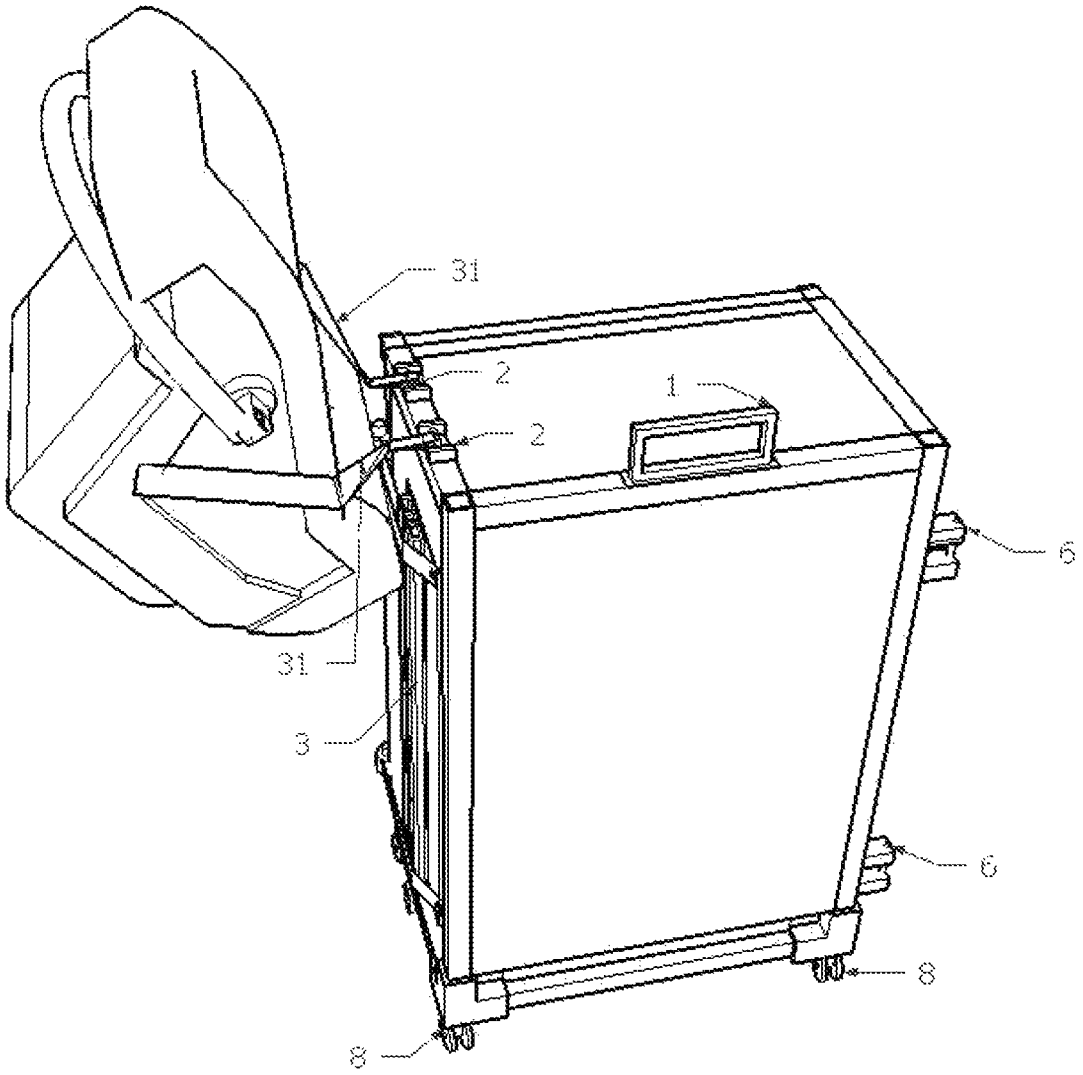
FIG. 6 Shows an overhead perspective view of the invention with an infant car seat attached using the connection points for the LATCH system.

FIG. 6 shows a front overhead perspective view of the invention with an infant car seat attached. This is for the purpose of illustrating that there are attachment points 2 on the exterior of the suitcase designed to accommodate clips such as those used by the LATCH system (used by many child and infant car seats), as well as other clips, and hooks such as carabiner style clips and other attachment mechanisms. The position and number of attachment points 2 may vary. The design of these attachment points may take multiple forms but in its preferred embodiment consists of a rigid structure (e.g. a short metal rod) roughly the diameter or width of a pencil securely connected to a face of the invention with sufficient clearance around said rigid structure to permit a clip such as the LATCH system clip to engage.

The invention claimed is:

1. A rigid suitcase comprised of a top, bottom, side walls, front, and rear, defining a main body, and further comprised of a handle and an integrated telescopic wheeled base that can be extended and retracted by the user, thereby making the suitcase convertible; said telescopic wheeled base is comprised of at least three wheels that are attached in position beneath the main body of the suitcase with one or more wheels that are attached to portions of the telescopic base that can be extended away from the main body of the suitcase horizontally along a plane substantially parallel to the plane of a flat surface when all wheels are resting on the flat surface; along one or both side walls of the suitcase adjacent to the telescopic wheeled base one or more luggage cart attachment points are incorporated, said luggage cart attachment points are comprised of a recess or groove within the rigid structure of the suitcase side wall of a size and shape that permits attachment points of one or more suitcases identical to this one to receive the horizontal telescopic structures of the telescopic wheeled base when extended, allowing it to function as a luggage cart.

2. The suitcase from claim 1 wherein the suitcase comprises one or more attachment points on the exterior of the suitcase that are characterized by a rigid bar structure that is fixed in place and has a gap between the rigid bar structure of the attachment point and any other part of the suitcase, said attachment point is used to connect the anchor straps and tether straps of child and infant car seats.

3. The suitcase from claim 1 wherein the luggage cart attachment points comprise a user controlled locking mechanism, said locking mechanism comprises a rigid pin that when open permits the luggage cart attachment points to accept the horizontal telescopic structures of the telescopic wheeled base so that they nest within the luggage cart attachment points; when the locking mechanism is closed the rigid pin moves in such a manner so as to be positioned at least in part beneath the horizontal telescopic structure of the telescopic wheeled base, when it is nested within the luggage cart attachment point of the identical suitcase.

4. A rigid suitcase comprised of a top, bottom, side walls, front, and rear, defining a main body, and further comprised of a handle and an integrated telescopic wheeled base that can be extended and retracted by the user, thereby making the suitcase convertible; said telescopic wheeled base is comprised of at least three wheels that are attached in position beneath the main body of the suitcase with one or more wheels that are attached to portions of the telescopic base that can be extended away from the main body of the suitcase horizontally along a plane substantially parallel to the plane of a flat surface when all wheels are resting on the flat surface; along one or both side walls of the suitcase adjacent to the telescopic wheeled base one or more luggage cart attachment points are incorporated, said luggage cart attachment points are comprised of a recess or groove within the rigid structure of the suitcase side wall of a size and shape that permits attachment points of one or more suitcases identical to this one to receive the horizontal telescopic structures of the telescopic wheeled base when extended, allowing it to function as a luggage cart; the telescopic wheeled base is further comprised of vertical support structures so that when it is extended these vertical support structures are connected to the portion of the telescopic wheeled base furthest from the main body of the suitcase and are substantially perpendicular to the horizontal telescopic structures of the telescopic wheeled base, in addition to stabilizing items that are placed on the telescopic wheeled base when it is extended to serve as a luggage cart, the vertical support structures serve as attachment points for a flexible receptacle that can be deployed by the user, said flexible receptacle is attached to the main body of the suitcase at one end and incorporates sleeves which slide over and receive said vertical support structures at the far end of the extended telescopic wheeled base thereby providing the functionality of a shopping cart.

* * * * *